United States Patent [19]

Kobayashi

[11] Patent Number: 4,867,804

[45] Date of Patent: Sep. 19, 1989

[54] MANUFACTURING PROCESS OF TOUGHENED BAINITIC NODULAR GRAPHITE CAST IRON

[75] Inventor: Toshiro Kobayashi, Aichi, Japan

[73] Assignee: Kurimoto Ltd., Japan

[21] Appl. No.: 79,031

[22] Filed: Jul. 29, 1987

[30] Foreign Application Priority Data

Dec. 26, 1986 [JP] Japan ..... 61-312457

[51] Int. Cl.[4] ..... C21D 5/00

[52] U.S. Cl. ..... 148/3; 148/139

[58] Field of Search ..... 148/139, 3, 321, 323; 420/9, 13, 16, 17, 25

[56] References Cited

U.S. PATENT DOCUMENTS 4,484,953 11/1984 Kovacs et al. ..... 148/139

FOREIGN PATENT DOCUMENTS 0203050 11/1986 European Pat. Off. ..... 148/139

*Primary Examiner*—Deborah Yee

*Attorney, Agent, or Firm*—Jones, Tullar & Cooper

[57] ABSTRACT

Taking the fracture initiation point of a nodular graphite cast iron into consideration, a manufacturing method of bainitic nodular graphite cast iron whose mechanical property is superior by far to the same cast iron obtained by the prior art is provided. The process comprises the steps of segregating elements of a material which are effective in strengthening residual austenite, and applying incomplete oil quenching in short time to the material, then applying incomplete austempering to the material.

6 Claims, 6 Drawing Sheets

A

| | | | |
|---|---|---|---|
| a-3 | AS-CAST STRUCTURE (EMBODIMENT) | 0.5h α+γ, Af, As, 623K 3h, A.C. | FERRITE + BAINITE |

B

| | | | |
|---|---|---|---|
| a-4 | a-1 FERRITE (COMPARATIVE EXAMPLE) | 0.5h γ, Af, As, 623K 3h, A.C. | BAINITE |
| a-5 | a-2 PEARLITE (COMPARATIVE EXAMPLE) | | |

F.C : FURNACE COOLING
A.C : AIR COOLING

| | PRE-STRUCTURE | HEAT-TREATMENT | STRUCTURE |
|---|---|---|---|
| a-1 | AS-CAST STRUCTURE | 1173K 24h F.C 933K 48h A.C. | FERRITE |
| a-2 | a-1 FERRITE | 1173K 1h 923K 2h A.C. | PEARLITE |

MANUFACTURING PROCESS OF TOUGHENED BAINITIC NODULAR GRAPHITE CAST IRON

BACKGROUND OF THE INVENTION

1. Field of the Invention

The present invention relates to a manufacturing process of strengthened and toughened bainitic nodular graphite cast iron (ductile cast iron) which is subjected to isothermal transformation treatment (hereinafter referred to as "austempering") to precipitate bainitic structure thereby obtaining a toughened material.

2. Prior Art

As is well known, a nodular graphite cast iron is generally obtained by the steps of adding explosively a small amount of Mg to a molten iron, spheroidizing the graphite morphology, and giving strength and toughness thereto. Since a series of successes in getting the speroidized graphite, studies and developments in the field have been directed toward the matrix looking for higher toughness thereof, and it has been proposed that the most useful method for the purpose is austempering, in other words, known as austempered ductile iron (ADI), which is now put in practical use in various components for machines.

It has been also found that because the nodular graphite cast iron thus austempered includes a large amount of Si which is a graphitization accelerating element, carbide which negatively affects the toughness is hard to precipitate, and a large amount of residual austenite is retained therein, which is very effective in improving mechanical properties of materials, enhancing thereby the application of such a treatment even more.

In the application of austempering, at first, full annealing of an as-cast product is carried out as a pretreatment, extending the results of studies about steel materials accumulated up to the present as well as principles based on such results. For example, as shown in FIG. 1 *a*-1, an as-cast product of nodular graphite cast iron is subject to two-stage annealing for full ferritization of the matrix thereof, and segregation of alloying elements, being contained in small quantities and existing microscopically in the as cost state, are completely diffused to obtain a homogeneous material. When necessary, a two-stage annealing, as shown in FIG. 11 *a*-2, is further applied to the ferritized material to be used as a prior structure, for full pearlitization of the base thereof, i.e., conversion to pearlitized nodular graphite cast iron.

The austempering is started either with such a ferritized matrix or pearlitized matrix as a prior structure, and after heating the material to reach its $\gamma$ range so as to fully austenitize the matrix and obtaining full solid solution of minor elements contained therein homogeneously into the austenite, the material is soaked into a predetermined isothermal salt bath and held therein up to the completion of transformation to bainite.

The foregoing is a conventional method for manufacturing strong and tough bainitic nodular graphite cast iron.

With the progress in obtaining tougher nodular graphite cast iron, the demand for this cast iron has been increasing particularly in such industrial fields as automobiles, machine tools and industrial machinery, and further tougher cast iron has been demanded. This is because it is quite attractive to get components for use in machines and equipment having sufficient toughness comparable to those of steel while maintaining its own properties of cast iron (such as abrasion resistance, heat resistance, corrosion resistance, lubricity, etc.).

Several attempts have been proposed in order to obtain further toughened bainitic nodular graphite cast iron each aiming at improvement of the matrix. In this connection, described hereunder is a summarized report on crack initiation and crack propagation which are confirmed by the inventor through fracture observation of a nodular graphite cast iron (the report titled "Fracture Toughness of Cast Iron" reported by Toshio Kobayashi and published in Bulletin of the Japan Institute of Metals 18 (1979) (512). Namely, in FIG. 12–A which shows the case of a ductile crack, large voids 2 (dimples) are formed under tensile stress (o) due to decohesion at a graphite-matrix interface 1 and with existing inclusions 3, small voids are formed and combined to form a crack. On the other hand, when a cleavage crack takes place directly in the low temperature range, it is often the case that the cleavage initiates at an eutectic cell boundary rather than at the graphite-matrix interface 1 itself. In this sense, FIG. 12-B shows a case in which: (1) dislocations are accumulated: (2) stress concentration occurs in the inclusions at the boundary of the eutectic cell 4 and in the carbide 5; (3) a cleavage crack 6 is thereby initiated. In the nodular graphite cast iron, it is often the case that a brittle crack is initiated at carbide or inclusion at the boundary between eutectic cells due to a segregation effect at the time of solidification.

Considering the foregoing observation, it is concluded that ductile cracks are generally initiated from the graphite portion and that the matrix structure has much effect in the event of cleavage fracture under low temperature. For that reason, removal of the brittle hard phase caused by segregation and full annealing or full normalizing aiming to refine ferrite grain size have been necessarily carried out as a pretreatment for austempering. However, there is a certain limit in the effect achieved by such pretreatment. Accordingly, a novel idea is needed to achieve a level of higher toughness.

SUMMARY OF THE INVENTION

It is, therefore, an object of the present invention to overcome the above-discussed limit of the prior art and to provide a novel manufacturing process for tough bainitic nodular graphite cast iron which can exceed the limit pertaining to the prior art, based on a novel concept considering that micro-segregation occurs easily at the boundary between graphite, and matrix as well as at the boundary between eutectic cells, these sites being easy fracture initiation sites.

In order to accomplish the foregoing object, the manufacturing process for tough bainitic nodular cast iron according to the present invention comprises a step of adding alloying elements at the time of melting a material, the alloying elements being effective in lowering the austempering temperature of iron, a step of micro-segregating the alloying said elements after its solidification at a boundary between a graphite and a matrix as well as at eutectic cell boundary portion, thereby obtaining a starting material as a pre-structure which still remains in the micro-segregated state, and a step of applying isothermal transformation treatment to the pre-structure starting from a temperature range within which the micro-segregated elements have not yet been completely diffused and homogenized.

It is preferable that the component micro-segregated at the boundary between the graphite and the matrix is Ni and/or Cu, more specifically, 1%–5% Ni and 0.5%–3.0% Cu, that the element micro-segregated at the eutectic cell boundary is Mn, more specifically, 0.3% –1.5% Mn, that the phase still remaining the micro-segregation is a structure oil-quenched after austenitization in short time, and that the temperature range within which the micro-segregation has not been completely diffused and homogenized is near the upper limit of a ($\alpha+\gamma$ range of the nodular graphite cast iron.

Other objects and features of the invention will become apparent in the course of the description in connection with the accompanying figures.

BRIEF DESCRIPTION OF THE FIGURES

FIG. 13 shows the relationship between ultimate tensile strength ($\sigma_B$and.J values (J1c and Jd); and FIG. 14 shows the temperature dependence of 0.2 pct proof stress ($\sigma$0.2), ultimate tensile strength ($\sigma_B$) and total elongation (E1) in static tensile test of QB' treated iron.

DETAILED DESCRIPTION

Described hereunder are function and effect presented by the invention with reference to the embodiments and accompanying figures.

When molten iron including elements which decrease austempering temperature of iron solidifies, the elements micro-segregate at the boundary between the graphite and the matrix as well as at the eutectic cell boundary portion.

The most preferable elements, which micro-segregate at the boundary between the graphite and the matrix and decrease the austenitizing temperature, are Ni and Cu.

At least 1% Ni is needed to serve as a typical austenite stabilizing element as well as to effectively obtain a bainitic structure by shifting the pearlite nose onto the long time side in the isothermal transformation curve (TTT curve), but when exceeding 5%, martensite formation in a phase of as-cast takes place making the control of the remaining austenite rather difficult. Therefore, the upper limit of Ni is set to 5%.

Then, 0.5% Cu is needed to serve in stabilizing the austenite in the same manner as Ni, but when exceeding 3%, spheroidization is inhibited thereby. Therefore, the upper limit of Cu is set to 3%.

On the other hand, the most preferable element, which micro-segregates on the eutectic cell boundary and decreases the austenitizing temperature, is Mn steel. Mn is well known as an austenite stabilizing element in a form of 12% Mn, for example, and at least 0.3% Mn is needed in the present invention, but when exceeding 1.5%, a tendency to white cast iron comes out making decomposition of cementite thereof difficult and resulting in less toughness. Therefore, the upper limit of Mn is set to 1.5%.

Referring to the accompanying figures, the upper half of FIG. 1 A shows an analytical line of a measured value of Ni distribution in the as cast phase of as-cast according to an embodiment of the invention and detected by an X-ray micro-analyzer (hereinafter referred to as "EPMA"), while lower half of FIG. 1 A shows an analytical line of a measured value of Mn distribution in the as cast state of as-cast according to the embodiment and detected by the EMPA.

Figure 1:
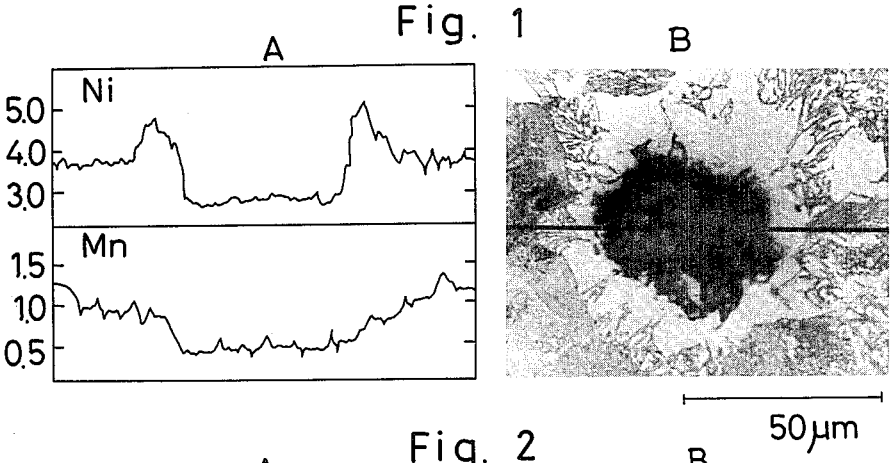
FIGS. 1 A and B to FIG. 3 A and B are analytical views respectively showing distribution states of Ni and Mn by an EPMA after as-casting, ferritization and pearlitization and corresponding microphotographs of metal structures.

FIG. 1 B shows microphotographs of metal structures each corresponding to the foregoing analytical line of the embodiment, and wherein a straight line across each photograph is a scanning line for the analysis.

When looking into the measured values and the microphotographs shown in these figures, it is found that Ni micro-segregates at the boundary between the graphite and the matrix, and that the segregation of Mn is considerably outstanding toward the eutectic cell boundary portion.

Briefly describing the critical meaning of the other elements, C and Si are useful for graphitization of carbonic material and preferable for improving the toughness. However, when less than 2.2% C is contained chill occurs easily, and when more than 3.2% the toughness is negatively affected. Therefore, it is preferable that C is contained within a range of 2.2%-3.2%.

When less than 1.8% Si is contained chill, and when more than 4.7% the toughness is affected by the embrittlement due to Si. Therefore, it is preferable that Si is contained within a range of 1.8%–4.7%. It is to be noted that Si is contained more than the usual cast iron because of inhibiting the tendency to white cast iron when Mn is increasingly added as the austenite stabilizing element.

Magnesium is a component most popularly used for spheroidalization of graphite. When less than 0.02% Mg is contained the spheroidization is incomplete thereby deteriorating castability. Therefore, it is preferable that Mg is contained within a range of 0.02%–0.10%.

Another feature of the invention exists in that austempering is applied to the pre-structure remaining after the above described phase of micro-segregation therein. That is, such treatment as ferritization (i.e., full annealing) or pearlitization (i.e., full normalizing) is not applied to the material before austempering as is done in the prior art, but the austempering is carried out with the Ni, Cu, Mn, etc. micro-segregating at the graphite periphery and at the eutectic cell boundary. In other words, the austempering is started with a pre-structure being either in the as-cast phase or in the oil quenched phase after incomplete austenitization in short time to refine the microstructure.

Figure 2:
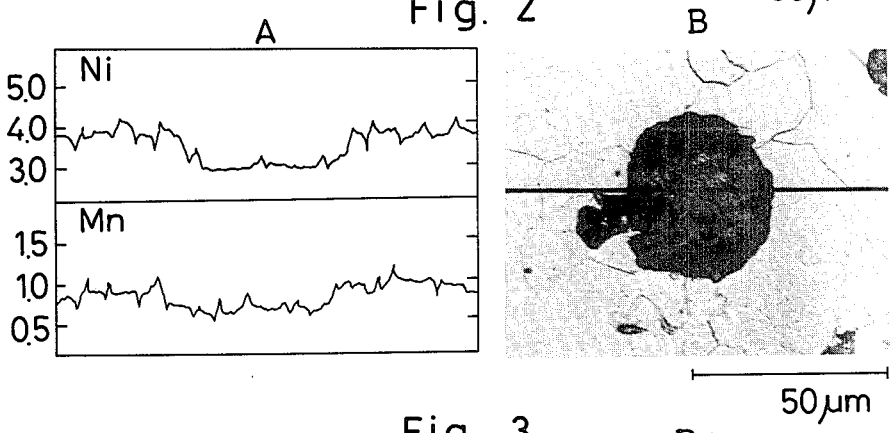
Figure 3:
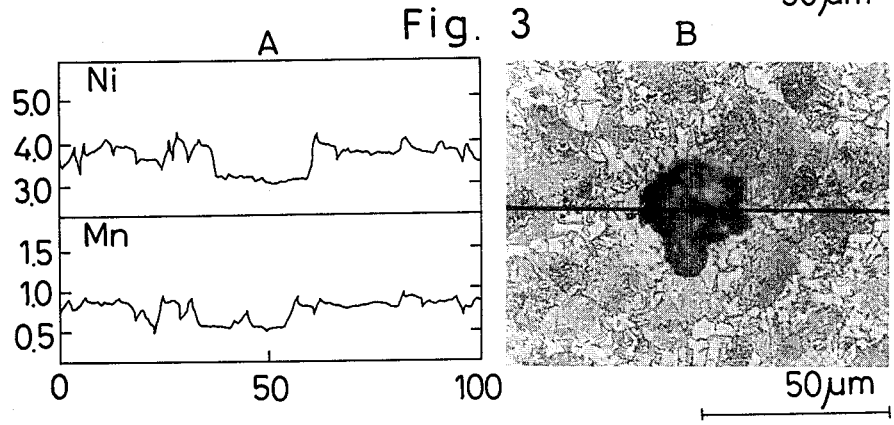
Figures 11, 12:
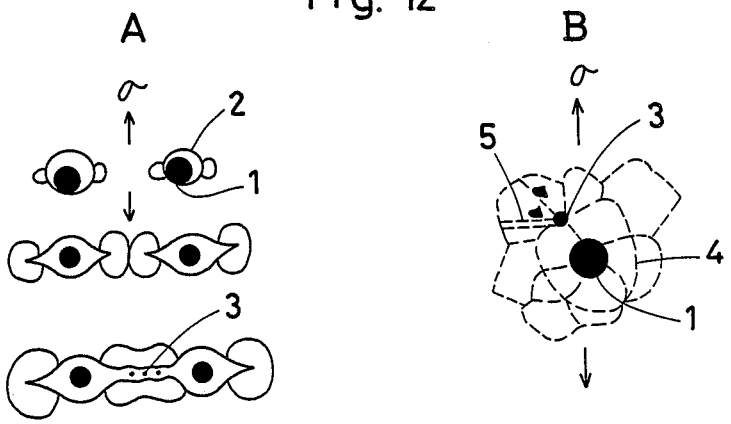
FIG. 11 shows diagrams of austempering applied to a yet further embodiment and a comparative example.
FIG. 12 A and B are explanatory views showing the principle of fracture of nodular graphite cast iron.

FIG. 2 A, B and FIG. 3 A, B, respectively show the micro-segregated states of Ni and Mn of the same material as that of FIG. 1 A and B which is ferritized (treatment shown in FIG. 11 *a*-1) and further pearlitized (treatment shown in FIG. 11 *a*-2) detected by the EPMA. When comparing these FIGS. 2 and 3 with FIG. 1, a great difference is found therebetween.

Figure 4:
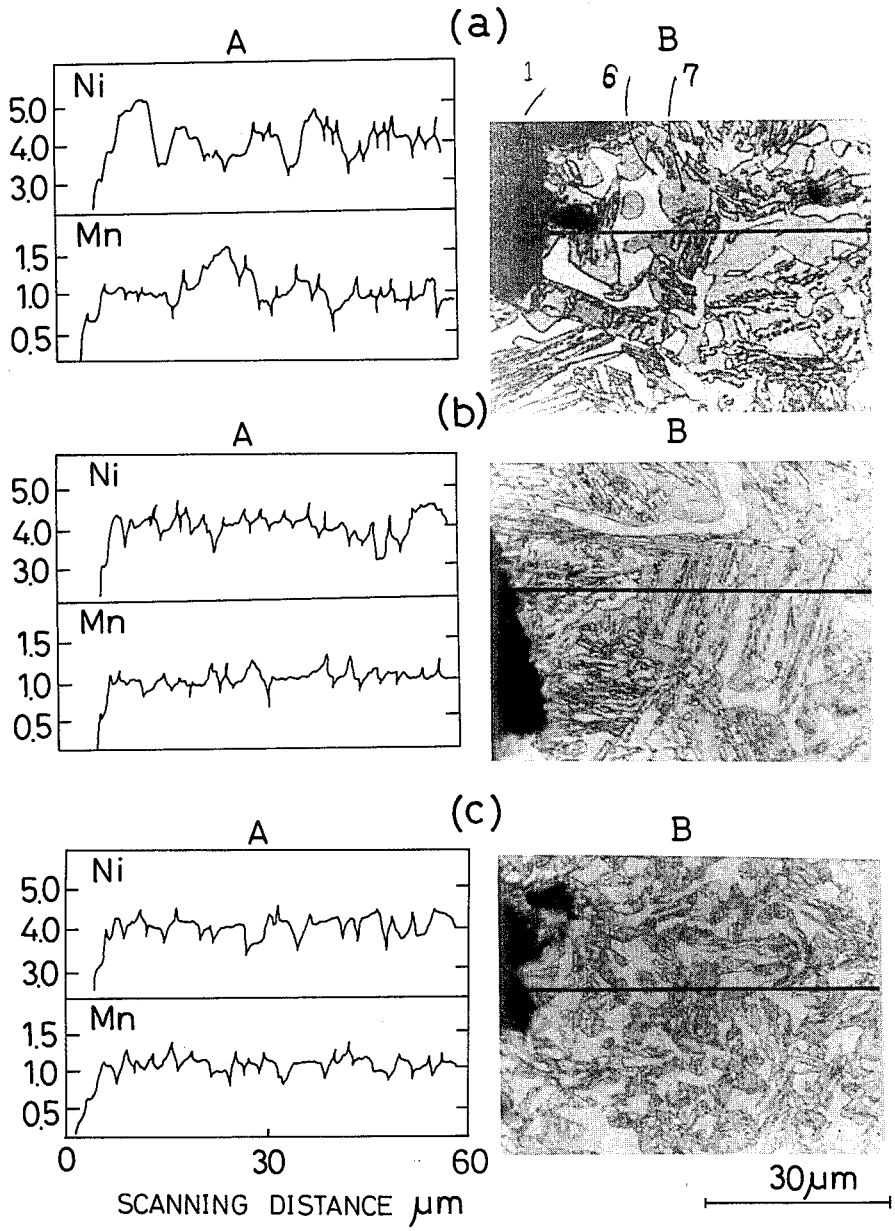
FIG. 4 (a) A and B, (b) A and B, and (c) A and B are diagrammatic views respectively showing distribution states of Ni and Mn by the EPMA after austempering applied to the structures of FIG. 1 to FIG. 3 used as pre-structures and corresponding microphotographs of metal structures.

FIG. 4 (a) A, B, (b) A, B and (c) A, B show the segregated state of Ni and Mn in the most suitable austempering condition (described later) showing the highest toughness in the foregoing three materials each used as the pre-structure and corresponding metal structures.

In the same manner as FIG. 1, the upper half of A in each figure shows an analytical line of measured value of Ni distribution which is detected by the EPMA, while the lower half shows the case for Mn. B in each figure shows a microscopic metal structure, the indicating the scanning line.

In the microscopic structures, the white area shows ferrite 6, and the grey area shows a bainite phase 7 containing residual austenite. FIG. 4 (*a*) shows an austempered material starting from an as-cast phase, and wherein it is found that, still maintaining the micro-segregation state of the pre-structure (FIG. 1), Ni and Mn are outstandingly concentrated and segregated around the graphite (left side of the photo) as well as in the bainite phase of the area corresponding to the previous pearlite phase including the eutectic cell boundary. A difference between the maximum value and the minimum value of such concentration is about 2% in Ni and L about 1% in Mn.

On the other hand, in the austempered materials each starting from a pre-structure of ferrite or pearlite shown in FIG. 4 (*b*) and (c), it is found that Mn is not concentrated and segregated, while Ni alone is concentrated and segregated by about 1% in the bainite.

A further feature of the invention exists in that austenizing temperature for the austempering is set to be in a temperature range wherein the micro-segregation is not fully diffused and homogenized. That is, the range located right under the upper limit in the $(\alpha+\gamma)$ range is most preferable.

It goes without saying that when such elements as Ni, Mn which decrease austenitizing temperature useful for the austempering are contained in the pre-structure in a peculiar state of segregation, the segregated area is preferentially and selectively austenitized prior to the remaining area of the matrix by heating the pre-structure keeping it within the range $(\alpha+\gamma)$. Furthermore, the Ni and Mn are preferentially diffused and concentrated into the austenite phase to stabilize it, thereby attaining improvement in toughness in the form of stable residual austenite even after the bainitization.

On the other hand, if the pre-structure is kept at the temperature reaching the $\gamma$ phase, the residual austenite may increase but austenitic particles thereof will be large. Since the austenitization takes place and spreads out simultaneously not only in the area near the fracture initiation point but all over the structure, it is definitely impossible to achieve the concentrated stabilization of austenite in the area near the fracture initiation point. When no micro-segregation takes place in the pre-structure, such undesirable tendency is increased, and partial transformation to a martensite phase takes place at the time of cooling after the austempering. Moreover, since carbon is contained at high level, becomes a problem thereby reducing toughness.

Figures 5, 6:
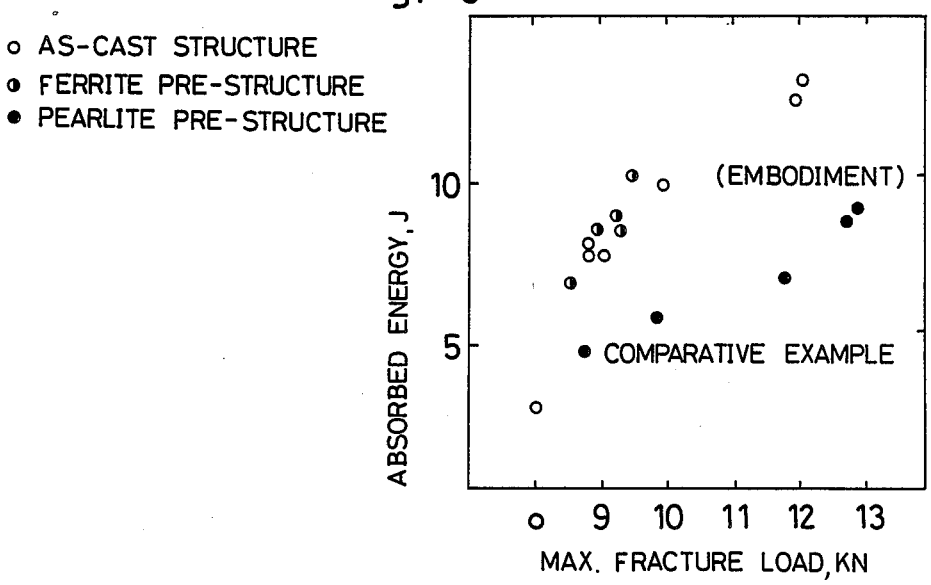
FIG. 5 A and B are heat treatment diagrams of an embodiment according to the present invention and a comparative example, respectively.
FIG. 6 and FIG. 7 show a result of material test carried out on another embodiment and a comparative example in view of comparison, respectively.

FIG. 5 shows heat-treating diagrams of a preferred embodiment in (A) which exhibits the foregoing preferable function and a comparative example in (B) which is not preferable.

As described above, when heating a structure either in an as-cast phase wherein Ni, Cu, etc. are micro-segregated around the graphite and Mn at the boundary of the eutectic cell or in an oil-quenched phase after austenitizing to be kept within the $(\alpha+\gamma)$ range (preferably near the upper limit thereof), carbon is preferentially diffused from the graphite and concentrated therearound, while cementite and other carbides contained in the pearlite are solidly dissolved in the pearlite area including the eutectic cell boundary. Accordingly, austenitization is locally more accelerated, and due to keeping the temperature within the $(\alpha+\gamma)$ range, distribution and concentration of alloying elements occurs in every phase, thereby the austenite being stabilized.

Since Ni and Mn are outstandingly concentrated in the area around the graphite thus locally and preferentially austenitized as well as in the area including the eutectic cell boundary, these elements together with C are diffused out of the bainite phase to the residual austenite phase and enriched, and therefore a very stable and tough austenite is formed as compared with the prior art in which fracture initiation point is caused thereby.

DESCRIPTION OF THE PREFERRED EMBODIMENTS

Advantages achieved by the present invention are supported by mechanical tests on the following embodiments and comparative examples.

(Embodiment 1)

FIG. 6 shows the result of measurements of the influence on several pre-structures. That is, an instrumented Charpy impact test was carried out on three materials, i.e., a material in the as-cast state, a material obtained by austempering a ferrite as a pre-structure from the $(\alpha+\gamma)$ range and a material obtained by austempering a pearlite as a pre-structure from the same range (each corresponding to FIG. 4 A, B and C), and the results thereof are shown in the figure in the form of a relation between the absorbed energy and the maximum fracture load. Comparing the balance (compatibility) between the strength and the toughness of these three materials, it is found that the balance is worse in the order of as-cast, ferrite and pearlite. High strength and low toughness of the pearlitic pre-structure (worst-balanced) are perhaps caused by the fact that, since carbon is supplied not only from the graphite but also from the cementite and other carbide, the diffusion length of the carbon is rather short and solid solution to austenite takes place in shorter time resulting in the high strength with brittleness.

(Embodiment 2)

Figure 7:
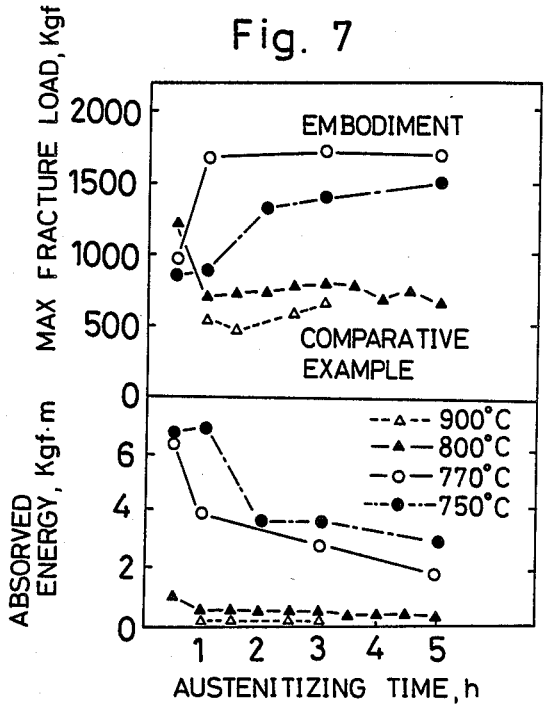

The austenitizing temperature of a material whose composition is shown in the following Table 1 is As (start of austenitization) 690° C., Af (finish of austenitization) 810° C. An upper half of FIG. 7 shows the maximum fracture strength (Kgf) obtained by austempering the materials at 900° C. and 850° C. being in the $\gamma$ range and that obtained by austempering at 770° C. and 750° C. lower than the former and being in the $(\alpha+\gamma)$ range, while the lower half shows absorbed energy (Kgf-m). In this connection, the isothermal salt bath temperature was set to 30° C. for every material.

TABLE 1

| C | Si | Mn (mass % unit) | Ni | Mg |
|---|---|---|---|---|
| 2.5 | 2.0 | 0.74 | 3.8 | 0.044 |

Mechanical property values shown in FIG. 7 means that higher toughness can be obtained by heating and keeping in the $(\alpha+\gamma)$ range than in the $\gamma$ range so far as the same composition is subject to the austempering.

(Embodiment 3)

Figure 8:
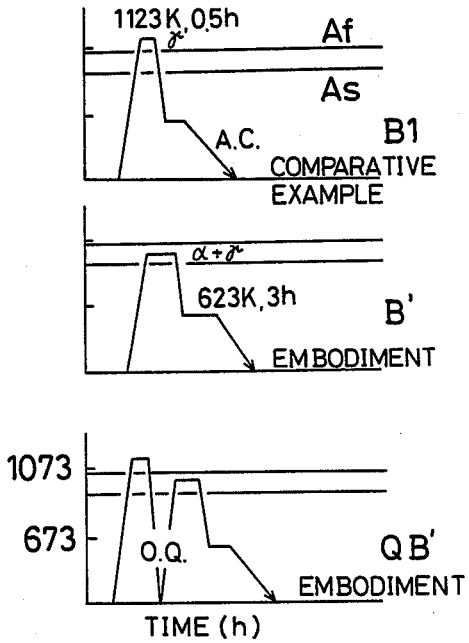
FIG. 8 shows diagrams of austempering applied to a further embodiment and a comparative example.

The material shown in Table 1 was heat-treated under three conditions shown in FIG. 8.

Figure 9:
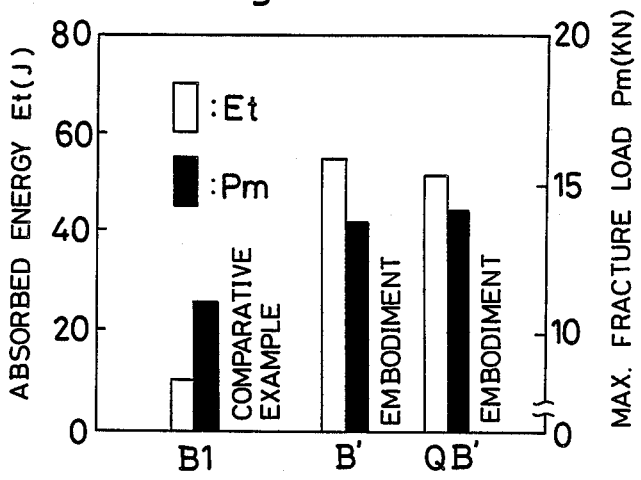
FIG. 9 shows a result of material test carried out on the embodiment and comparative examples.

That is, B1 (comparative example) in the figure shows the material of the composition in Table 1 which was austempered from the $\gamma$ range using an as-cast as a pre-structure (in the same manner as prior art). B' shows the material of Table 1 austempered from the $(\alpha+\gamma)$ range also using an as-cast as a pre-structure, and QB' (embodiment) shows the material austempered from the $(\alpha+\gamma)$ range using a material oil-quenched in the range as a pre-structure. B1, B' and QB' shown in FIG. 9 are mechanical property values obtained from these materials, whereby it is found that incomplete austempering i.e. austempering from the $(\alpha+\gamma)$ range is clearly superior to complete austempering from the range.

(Embodiment 4)

Following Table 2 shows compositions of materials subject to tests to a certain the advantages of Ni and Mn.

TABLE 2

| No | C | Si | Mn | Ni (mass % unit) | Mn | Remarks |
|---|---|---|---|---|---|---|
| 1 | 2.48 | 2.00 | 0.74 | 3.80 | 0.044 | Embodiment |
| 2 | 2.44 | 2.09 | 0.81 | — | 0.040 | Comparative example |
| 3 | 2.43 | 1.96 | 0.23 | 3.77 | 0.045 | Embodiment |
| 4 | 2.41 | 1.92 | 0.28 | — | 0.043 | Comparative example |

Figure 10:
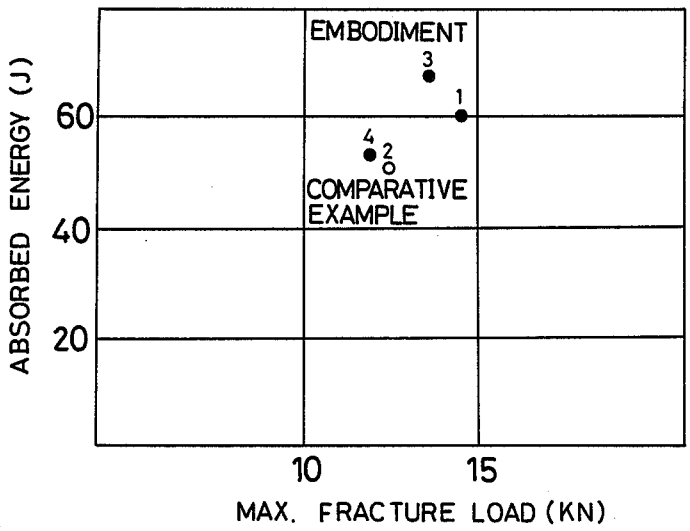
FIG. 10 shows a result of material test carried out on a still further embodiment and a comparative example.

FIG. 10 shows a result of austempering the material of the above composition during the isothermal salt bathing at 350° C. after heating and keeping those within the $(\alpha+\gamma)$ range using an as-cast as a pre-structure.

It is found that even when satisfying two requirements of pre-treatment and temperature range for the austempering, a considerable difference occurs in the result so long as the remaining one requirement of compositions is not satisfied.

(Embodiment 5)

The chemical composition of the ductile irons in this embodiment is shown in Table 3. Both elements Ni and Mn were added to irons I to IX are comparative examples containing either Ni or Mn or none of them or Ni and/or Mn outside the ranges 1–5 and 0, 3–1.5, respectively.

TABLE 3

| Iron | C | Si | Mn | Ni | P | S | Cr | Mg | As | Af |
|---|---|---|---|---|---|---|---|---|---|---|
| | Chemical Composition (Mass Pct) and Transformation (K) of Test Irons | | | | | | | | | |
| I | 2.48 | 1.965 | 0.74 | 3.8 | — | 0.013 | 0.02 | 0.0435 | 963 | 1083 |
| II | 2.50 | 4.08 | 0.89 | 3.9 | — | 0.09 | 0.03 | 0.048 | 1023 | 1153 |
| III | 3.11 | 2.28 | 0.61 | 3.53 | 0.056 | 0.017 | 0.04 | 0.051 | 1103 | 1123 |
| IV | 2.44 | 2.09 | 0.81 | 0.037 | — | 0.012 | 0.01 | 0.040 | 1013 | 1118 |
| V | 3.21 | 1.98 | 0.62 | 0.06 | 0.050 | 0.019 | 0.03 | 0.042 | 1053 | 1073 |
| VI | 2.43 | 1.76 | 0.23 | 3.77 | 0.017 | 0.009 | 0.02 | 0.045 | 1003 | 1083 |
| VII | 2.41 | 1.92 | 0.28 | 0.00 | 0.019 | 0.008 | — | 0.043 | 1063 | 1123 |
| VIII | 3.25 | 3.00 | 0.22 | 0.00 | 0.022 | 0.007 | — | 0.051 | 1063 | 1153 |
| IX | 3.79 | 2.18 | 0.17 | 0.06 | 0.017 | 0.007 | 0.01 | 0.029 | 993 | 1023 |

The heat treatment performed in this embodiment is schematically shown in FIG. 8. Symbol B' means the austempering from the $(\alpha+\gamma)$ range, while symbol Q means the oil quenching from the $\gamma$ range.

That is to say, III-B' means a product obtained by austempering the chemical composition III in Table 1 from the $(\alpha+\gamma)$ range starting from as-cast, and III-QB' means a product contained by oil-quenching the same composition and austempering from the (? +? ). Both IX-B' and IX-QB' are products obtained by heat treatment of the chemical composition IX (comparative example) in Table 3.

In order to investigate fracture properties on these irons, the elastic-plastic fracture toughness tests were carried out by the electrical potential method under a static loading condition and also by the instrumented precracked Charpy test with compliance changing rate method and key-curve analysis under a dynamic loading condition. This evaluation system has been recently developed by Kobayashi et. al. and is known as CAI (computer Aided Instrumented Carpy Impact Testing System). The relationship between tensile stress$\sigma_B$ and crack initiation resistance toughness (static JIC and dynamic Jd) was obtained as shown in FIG. 13.

In FIG. 13, the QB' treated iron III (hereinafter referred to as III-QB') exhibits an excellent combination of the toughness and strength as might be expected from the results in the preceding section.

That is to say, a result is that JIC ◇ and Jd ○ of the III-QB' are improved more than ◆ and ● of the III-B' iron being the same composition, while with respect to V and IX QB' is inferior to the B'.

Temperature dependence of the 0.2 pct proof stress ($\sigma$0.2), tensile strength ($\sigma$B), and total elongation (E1) for the III–QB' iron are shown in FIG. 14, respectively. It is clearly found that an abnormal elongation appears near 198 K. in iron. The extent of the abnormal elongation temperature range in the III– QB' iron just correspond to the temperature range between Ms and Md, where Ms temperature was estimated using the formula reported for stainless steel. Therefor, it is assumed that this phenomenon has a feature of TRIP. The means that, asa result of QB' treatment, the III iron alone is superior to the remaining compactive examples (V, IX) in terms of $\sigma_B$, $\sigma_a{}^2$, and E. In particular, considerably excellent elongation at a low temperature (175° K.) exhibits the TRIP effect, which suggests a desirable applicability as an excellent low temperature material. In effect, it was found in this embodiment that toughness and properties under low temperature after the QB′ process were outstandingly improved only with respect to the material of this invention, and no appreciable improvement was obtained by the same QB′ process with respect to the process with respect to the other materials. This is because it is estimated that the crystal grains of the residual austenite are effectively refined due to behavior of Ni and Mn by the oil quenching previous to the austempering.

What is claimed is:

1. A manufacturing process for making toughened bainitic nodular cast iron, comprising the steps of:

adding Ni and/or Cu and Mn as alloying elements together at the time of melting an iron material, said alloying elements being effective in lowering the austempering temperature of iron;

micro-segregating said alloying elements during their solidification with Ni and/or Cu micro-segregated at a boundary between a graphite and a matrix as well as with Mn micro-segregated at a eutectic cell boundary, thereby obtaining a starting iron material as a pre-structure still retaining the micro-segregated alloying elements;

applying oil quenching, incompletely and after short time heating, to said pre-structure to retain said micro-segregation before austempering and obtain a fine grain size; and austempering starting from a temperature range within which the micro-segregated alloying elements have not yet been completely diffused and homogenized yielding a final residual austenite concentrated in Ni and/or Cu and Mn.

2. The manufacturing process as defined in claim 1, further comprising the step of:

austenitization, incompletely, before oil quenching.

3. The manufacturing process as defined in claim 1, wherein the temperature range within which the micro-segregated alloying elements have not been completely diffused and homogenized is near an upper limit of a $(\alpha+\gamma)$ range of the nodular graphite cast iron.

4. The manufacturing process as defined in claim 20, wherein the alloying elements micro-segregated at the boundary between the graphite and matrix comprise, 1%–5% Ni and/or 0.5%–3.0% Cu, and wherein the alloying elements micro-segregated at the eutectic cell boundary portion comprises, 0.3%–1.5% $M_n$.

5. The manufacturing process as defined in claim 4, further comprising the step of:

austenitization, incompletely, before oil quenching,

6. The manufacturing process as defined in claim 5, wherein the temperature range within the micro-segregated alloying elements have not yet been completely diffused and homogenized is near an upper limit of a $(\alpha+\gamma)$ range of the nodular graphite cast iron.

* * * * *